US006955574B2

(12) United States Patent
Rogerson

(10) Patent No.: US 6,955,574 B2
(45) Date of Patent: Oct. 18, 2005

(54) SHACKLE POCKET BUOY

(76) Inventor: L. Keith Rogerson, #9 Fourth Ave., Isle of Palms, SC (US) 29451

( * ) Notice: Subject to any disclaimer, the term of this patent is extended or adjusted under 35 U.S.C. 154(b) by 0 days.

(21) Appl. No.: 10/767,670

(22) Filed: Jan. 29, 2004

(65) Prior Publication Data

US 2005/0170718 A1 Aug. 4, 2005

(51) Int. Cl.[7] ..... B63B 22/02
(52) U.S. Cl. ..... 441/3
(58) Field of Search ..... 441/3, 6; 114/230.1, 114/230.2, 230.26, 230.28, 230.29

(56) References Cited

U.S. PATENT DOCUMENTS 2,381,394 A * 8/1945 Beach, Jr. ..... 441/3
3,950,806 A * 4/1976 Puchois ..... 441/3
3,992,934 A 11/1976 Clark
4,103,379 A * 8/1978 Wolfe ..... 441/11
4,771,722 A * 9/1988 Tihany ..... 114/345
4,788,927 A * 12/1988 Casey ..... 114/249
4,932,700 A 6/1990 Hart
5,020,175 A * 6/1991 Kirkpatrick et al. ..... 5/652
5,212,939 A 5/1993 Pratt, Jr.
5,299,962 A * 4/1994 Saulnier et al. ..... 441/26
5,390,618 A 2/1995 Wolff et al.
5,593,331 A * 1/1997 Duren ..... 441/6
6,282,879 B1 9/2001 Bonaiti et al.
6,532,885 B1 3/2003 Cordoba

* cited by examiner

*Primary Examiner*—Ed Swinehart
(74) *Attorney, Agent, or Firm*—Dority & Manning, P.A.

(57) ABSTRACT

A buoy for tethering a vessel has a pocket that retains a fastening device below an outer surface of the buoy to protect the vessel from contact by the fastening device. A method of manufacturing the buoy utilizes a processing line that molds elements of the buoy including the pocket.

35 Claims, 4 Drawing Sheets

SHACKLE POCKET BUOY

FIELD OF THE INVENTION

This invention relates to buoys. More specifically, the invention is directed to a buoy having a pocket in which a tethering device is retained to prevent its contact and damage to a vessel tethered to the buoy.

BACKGROUND OF THE INVENTION

Mooring buoys are well known for mooring a vessel in open water without having to dock the vessel pierside. One drawback of the typical mooring buoy is its exposed shackle, which can contact a vessel hull due to wave action and other forces acting on the vessel and the buoy. Contact between the vessel hull and the conventional buoy mars the vessel hull and in some cases, may cause significant damage and affect the vessel's seaworthiness.

A mooring buoy is needed that safeguards vessel hulls from contact by exposed shackles and the associated damage caused by such contact.

BRIEF SUMMARY OF THE INVENTION

The present invention provides a buoy having a shackle pocket in which the shackle is recessed beneath a plane of an outer surface of the buoy to protect a vessel moored to the buoy from exposure to the shackle. The component parts of the buoy are simple and economical to manufacture, assemble, and use. Other advantages of the invention will be apparent from the following description and the attached drawings or can be learned through practice of the invention.

According to one aspect of the invention, a buoy for mooring vessels is provided with a shell having an outer surface with a pocket defined therein. The pocket is formed to maintain a fastening device below a plane of the outer surface in a direction of a midpoint of the buoy such that a vessel moored to the buoy is shielded from contact by the fastening device. A buoyant element is retained within the shell to provide flotation for the buoy.

In another aspect of the invention, a mooring device for a buoy is provided having a shackle for attaching a mooring line from a vessel; a pocket defined in a surface of a buoy to retain the shackle below the surface in a direction of a midpoint of the buoy such that a hull of the vessel moored to the buoy is shielded from contact by the shackle; and a protrusion disposed proximate the pocket depending from the surface of the buoy in a direction away from the midpoint, the protrusion configured to increase a size of the pocket such that the shackle is further removed from the surface of the buoy, the protrusion further configured to make contact with the vessel in lieu of the shackle.

Other aspects and advantages of the invention will be apparent from the following description and the attached drawings, or can be learned through practice of the invention.

BRIEF DESCRIPTION OF THE DRAWINGS

The above and other aspects and advantages of the present invention are apparent from the detailed description below and in combination with the drawings in which.

DETAILED DESCRIPTION OF THE DRAWINGS

Figure 1:
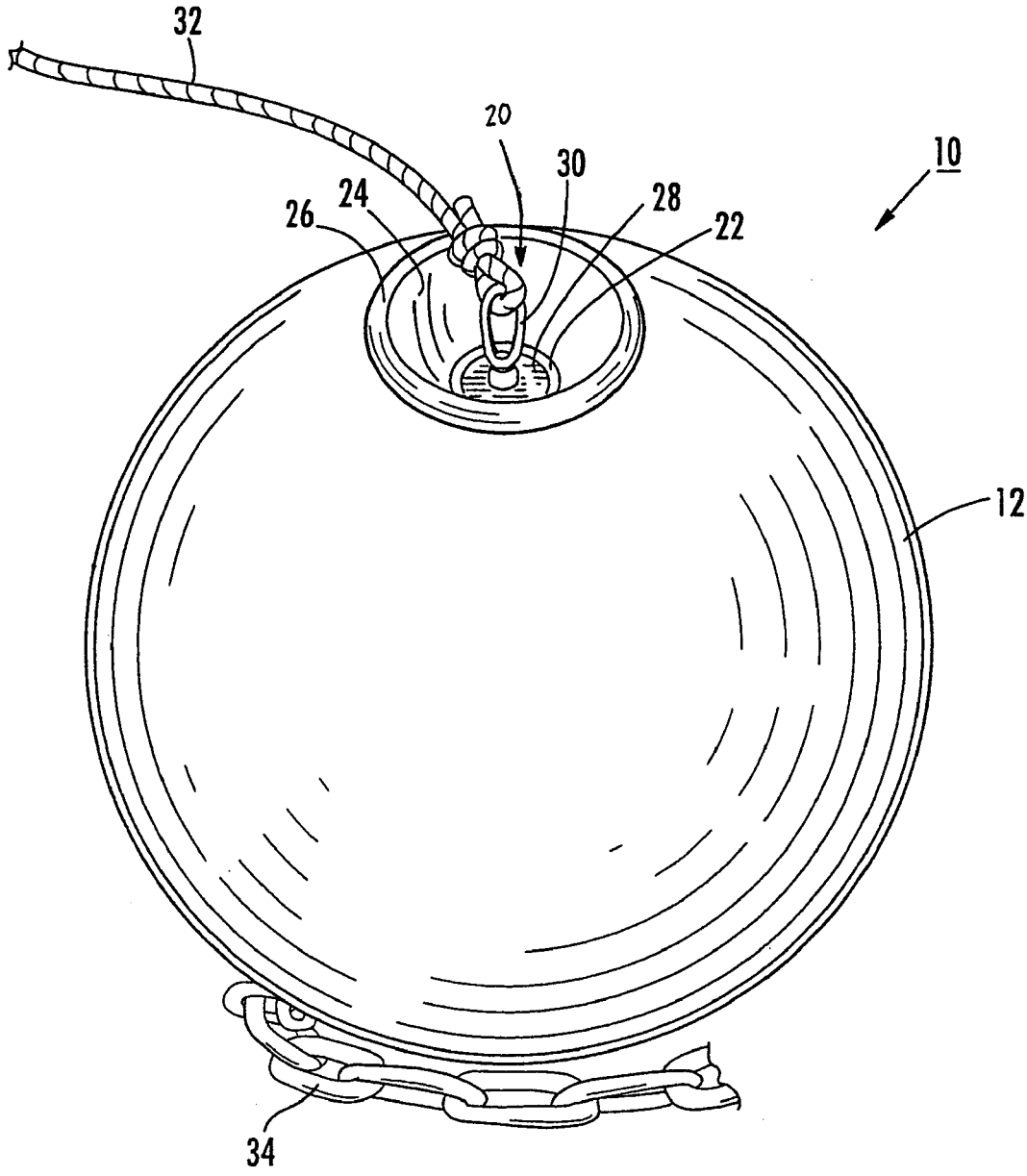
FIG. 1 is a perspective view of one embodiment of a mooring buoy in accordance with the present invention.

Detailed reference will now be made to the drawings in which examples embodying the present invention are shown. The detailed description uses numerical and letter designations to refer to features in the drawings. Like or similar designations in the drawings and description have been used to refer to like or similar parts of the invention.

The drawings and detailed description provide a full and detailed written description of the invention, and of the manner and process of making and using it, so as to enable one skilled in the pertinent art to make and use it, as well as the best mode of carrying out the invention. However, the examples set forth in the drawings and detailed description are provided by way of explanation of the invention and are not meant as limitations of the invention. The present invention thus includes any modifications and variations of the following examples as come within the scope of the appended claims and their equivalents.

Figure 2A:
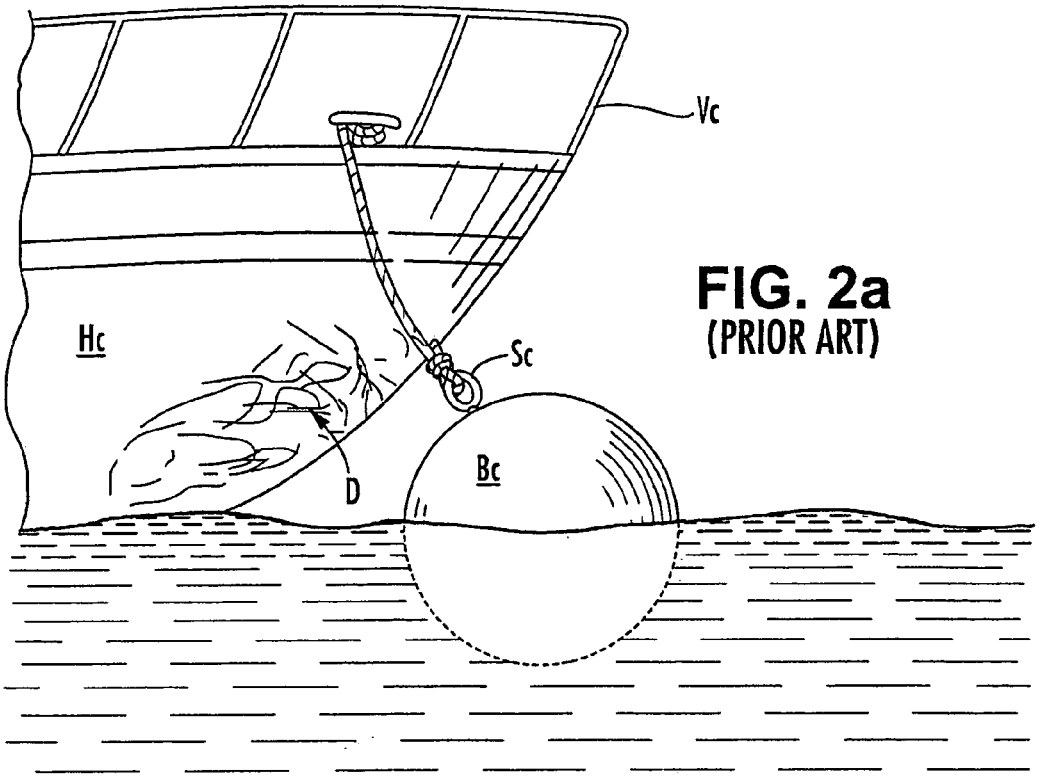
FIG. 2a (PRIOR ART)
FIG. 2*a* shows a conventional buoy and particularly, damage to a vessel hull caused by an exposed shackle.
Figure 2B:
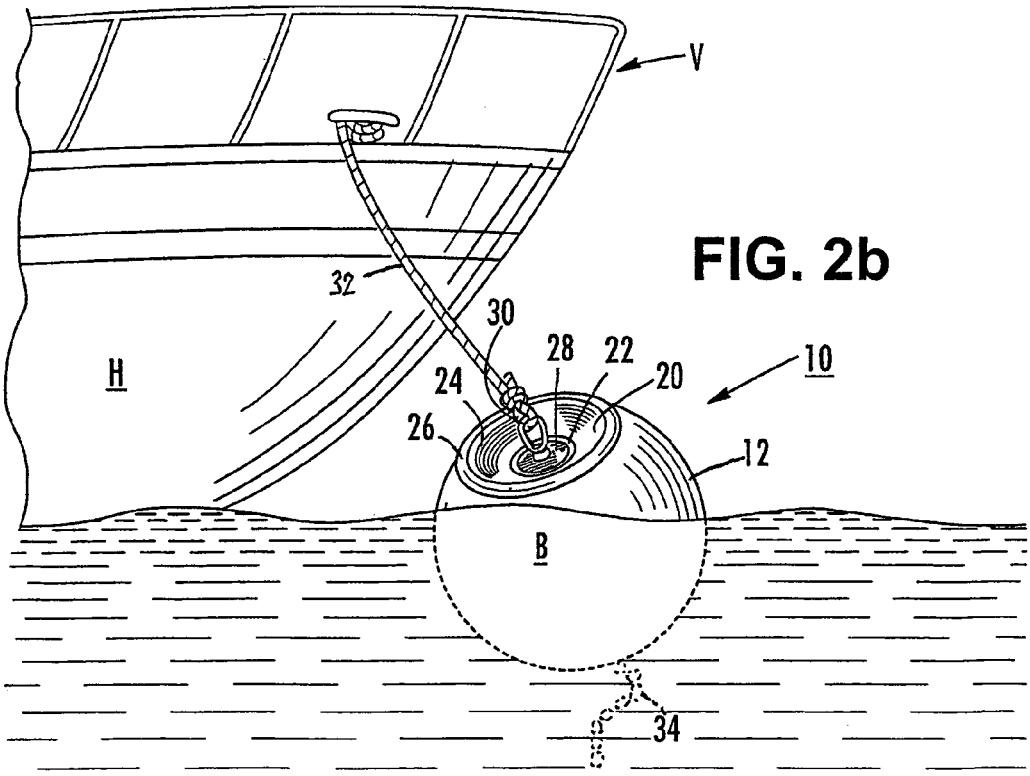
FIG. 2*b* shows a buoy similar to FIG. 1.
Figure 3:
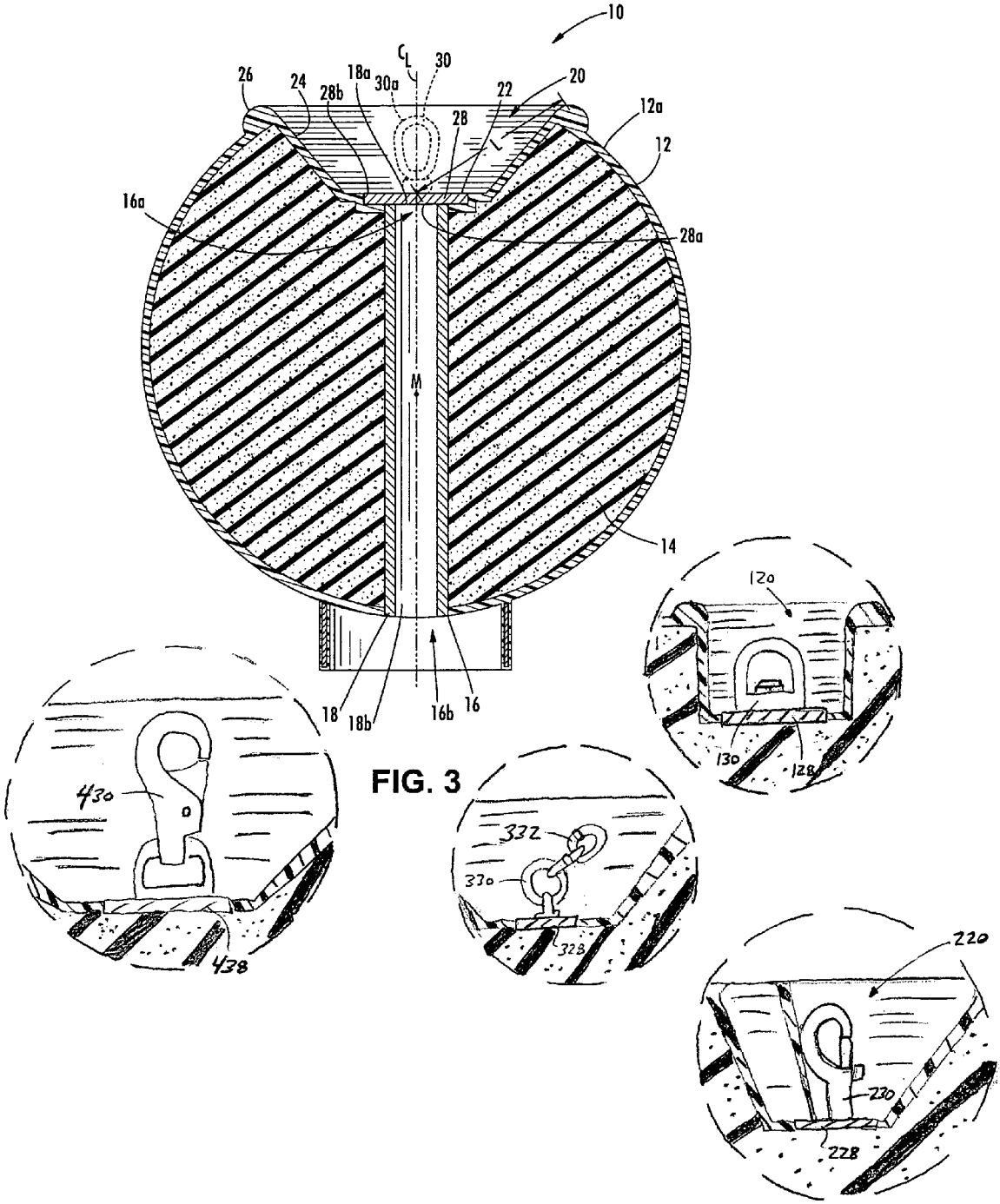
FIG. 3 is a cross sectional view of a buoy similar to FIGS. 1 and 2*b* and including a ballast device.

As broadly embodied in FIGS. 1, 2*b* and 3, a buoy, generally designated by the number 10, is shown with a shackle pocket 20 in which a mooring or fastening device such as a shackle 30 is embedded to protect a vessel hull from contact and damage by the shackle 30. As described in detail below, the components of the buoy 10, their placement and dimensions are modifiable to accommodate various vessel and anchor line sizes and manufacturing requirements and are not limited to only those examples shown in the Figures. For instance, although the buoy 10 is shown generally ball-shaped, any shape such as can-shaped, box-shaped, pyramid-shaped, nun-buoy (cone) shaped, drum-shaped, or combinations of these and other shapes are within the scope of the present invention. Additionally, the buoy 10 can be sized to meet any manufacturing or customer requirement such as by adjusting its diameter (from about 12 inches to about 32 inches) and its weight (from about 25 pounds to about 530 pounds).

With particular reference to FIG. 1, the buoy 10 generally includes a shell 12 in which the shackle pocket 20 is formed and in which the shackle 30 is attached. The shackle pocket 20 defines a support plate pocket 22 and a bowl-shaped wall 24. A protrusion or annular lip 26 is formed about the shackle pocket 20 in this example. Also, a complementarily shaped support plate 28 is seated in the support plate pocket 22 to protect other components of the buoy 10 from external forces. For instance, a line 32 from a vessel V (see, e.g., FIG. 2*b*) is attached to the shackle 30, which is attached to the support plate 28. An anchor chain 34 is also attached to the support plate 28. Described by example operation below, as the line 32 and the anchor chain 34 move due to external forces, they act on the support plate 28 rather than other components of the buoy 10.

The shell 12 in FIG. 1 is made of made of any impact- and weather-resistant material such as polyethylene, more particularly, high-density polyethylene (HDPE), or polypropylene, polyvinyl chloride, rubber, fiberglass, nylon, POM (polyoxymethylene; i.e., acetal plastic), PEEK (polyetheretherketone), or any natural (e.g., wood) or synthetic materials or their combinations suitable for flotation on a body of water. In one aspect of the invention, the shell 12 has a wall thickness of about 3/16 of an inch, although other wall thicknesses can be made to meet specific requirements. A method of producing the buoy 10 including the shell 12 is described in detail below.

The shackle 30 in FIG. 1 is swivelably attached to the support plate 28 to permit the vessel V (FIG. 2*b*) freedom to swing about the buoy 10 as wind and current change. The shackle 30 can be any fixed or swivelable fastening device such as a link of chain, a D-shaped ring, an O-shaped ring, a clasp, a hook and eye apparatus, or combinations of these and other devices suitable for attaching the line 32.

Turning to FIG. 2*a*, a conventional mooring buoy $B_c$ is shown with a typical ring-type shackle $S_c$ projecting from the mooring buoy $B_c$. Due to wave action and other external forces on one or both of a tethered vessel $V_c$ and the mooring buoy $B_c$, the exposed shackle $S_c$ repeatedly strikes a hull $H_c$ of the vessel $V_c$ causing scratches and dents at area D. With repeated exposure and sufficient force, the shackle $S_c$ can compromise the vessel hull $H_c$ and adversely affect seaworthiness of the vessel $V_c$.

FIG. 2*b* shows the unique shackle pocket 20 in operation. In this example, the vessel V is moored to the buoy 10 by attaching the line 32, which can be a chain, a rope, a cable, a line or similar rigging. The buoy 10 itself is anchored in an area of water by the anchor chain 34, which also can be a rope, cable, line or the like. As shown, the shackle 30 is safely recessed within the shackle pocket 20 in contrast to the conventional mooring buoy $B_c$ and its exposed shackle $S_c$. Thus, the shackle 30 does not contact a hull H of the vessel V due to wave or wind action or movement of the vessel V or varying aspect angles of the buoy 10 and the vessel V relative to each other.

FIG. 3 shows a detailed cross-section of the buoy 10. The shell 12 encapsulates a buoyant element 14, which is an expanded polystyrene fill material in this example. As known, polystyrene is a polymer of styrene, and expanded polystyrene appears as a rigid white foam often used as packing or insulation material. A suitable expanded polystyrene fill material is available from Huntsman Chemical Corporation headquartered in Houston, Tex. Other materials or elements that are lighter than water are also suitable to provide flotation to the buoy 10. For instance, polyurethane foam, cork, a gas such as helium, or combinations of these elements can be substituted for polystyrene.

FIG. 3 further shows a ballast 62, which is attached to or added in the buoy 10 to positively affect a characteristic of the buoy 10. For instance, by adding weight (i.e., counterweights) in the form of the ballast 62 in specific regions of the buoy 10, above-water exposure of the buoy 10 can be controlled. Also, upright stability of the buoy 10 can be ensured to maintain an aspect of the shackle pocket 20 relative to a horizontal plane; i.e., to maintain a centerline $C_L$ of the buoy 10, e.g., +/−30 degrees of the horizontal plane for 360 degrees of rotation. Alternatively stated, the ballast 62 can be utilized to control bobbing, rolling, and drifting behaviors of the buoy 10.

Also shown in FIG. 3, a passage or core 16 is coaxially aligned with the centerline CL of the buoy 10. The core 16 has a first opening 16*a* and a second opening 16*b* and passes through a midpoint M of the buoy 10.

A pipe or tube 18 inserted in the core 16 and is therefore also coaxially aligned with the centerline $C_L$ and passes through the midpoint M. The tube 18 defines a first end 18*a* and a second end 18*b*, which respectively lie in co-circumferential relationship with the first and second openings 16*a*, 16*b* of the core 16.

In one aspect of the invention, an inner diameter of the tube 18 is about 1½–3 inches but can be sized to accommodate various sizes of anchor chain 34. Similarly, a length of the tube 18 can be varied in accordance with a size of the buoy 10.

The tube 18 is made from any material such as a hardened plastic (having a thickness of at least about ¼ inch polyethylene), a metal, or another suitably hard material made to resist wear and tear by the anchor chain 34 as the anchor chain 34 moves within the tube 18 due to wave or wind action, a motion of the vessel V, or combinations of these external forces. Further description of the tube 18 and its attachment and interaction with the support plate 28 are discussed below.

FIG. 3 also shows the shackle pocket 20 recessed in a surface 12*a* of the shell 12 and centered about the centerline $C_L$. As briefly introduced above, the support plate 28 is seated in the support plate pocket 22 of the shackle pocket 20. The support plate 28 is secured to the support plate pocket 22 such as by press-fitting or molding, or by adhesives, screws, rivets, bolts, and similar mechanical attachments.

The first end 18*a* of the tube 18 is attached to the support plate 28 on one side 28*a* such as by welding or appropriate mechanical attachment. The shackle 30 is attached to an opposing side 28*b* of the support plate 28 by adhesives, screws, rivets, bolts, and similar mechanical attachments. In this manner, as the anchor chain 34 (see, e.g., FIG. 2*b*) moves within the tube 18 due to the external forces noted above, the support plate 28 receives and diffuses the forces, which protects other components of the buoy 10 such as the buoyant element 14.

Also shown in FIG. 3, the shackle pocket 20 defines the bowl-shaped wall 24 briefly introduced above. The wall 24 is annular and slopes downwardly in a direction of the midpoint M in this example. A slope of the wall 24 from about 25 degrees to about 75 degrees relative to the centerline CL effectively recesses the shackle 30 for protection of the vessel hull H. Other angles or slopes of the bowl-shaped wall 24 can also be provided. It will be further appreciated that the exemplary pocket 20 can be other than bowl-shaped, such as a box-shape, a pyramid-shape, a funnel-shape or combinations of these and other shapes.

FIG. 3 further shows an annular protrusion or lip 26 formed on the outer surface 12*a* of the shell 12 near the pocket 20. As shown, the lip 26 depends from the surface 12*a* in a direction away from the midpoint M approximately ½ inch to about 6 inches from the surface 12*a*. Various sizes and shapes of the lip 26 can be provided to accommodate manufacturing or customer requirements. For example, the annular lip 26 can be a series of raised bumps or the like. Alternatively, the annular lip 26 can be a collar device made for permanent affixation to the buoy 10 after the buoy 10 is formed.

Further, the collar can be detachable for subsequent attachment to or detachment from the buoy 10.

As shown, the annular lip 26 virtually increases a depth or length L of the pocket 20 relative to the surface 12*a* to further shield the shackle 30 within the pocket 20.

Specifically, the lip 26 serves to limit an extent of a distal end 30*a* of the shackle 30 since the length L of the pocket 20 from proximate the plate pocket 22 at the centerline $C_L$ to an outermost edge of the lip 26 is greater than the extent of the distal end 30*a*. Thus, the distal end 30*a* terminates short of the outermost edge of the lip 26; i.e., within the pocket 20. However, even without the lip 26, the pocket 20 is sufficiently deep to terminate the distal end 30*a* of the shackle 30 below the surface 12*a* of the shell 12. Alternatively stated, if the shell 12 covered the pocket 20, the distal end 30*a* would also be covered. Accordingly, with further reference to FIG. 2*b*, the lip 26 will make contact with the vessel V instead of the shackle 30 in the event the buoy 10 pitches toward the vessel V in a manner that directs the pocket 20 toward the vessel V.

Figure 4:
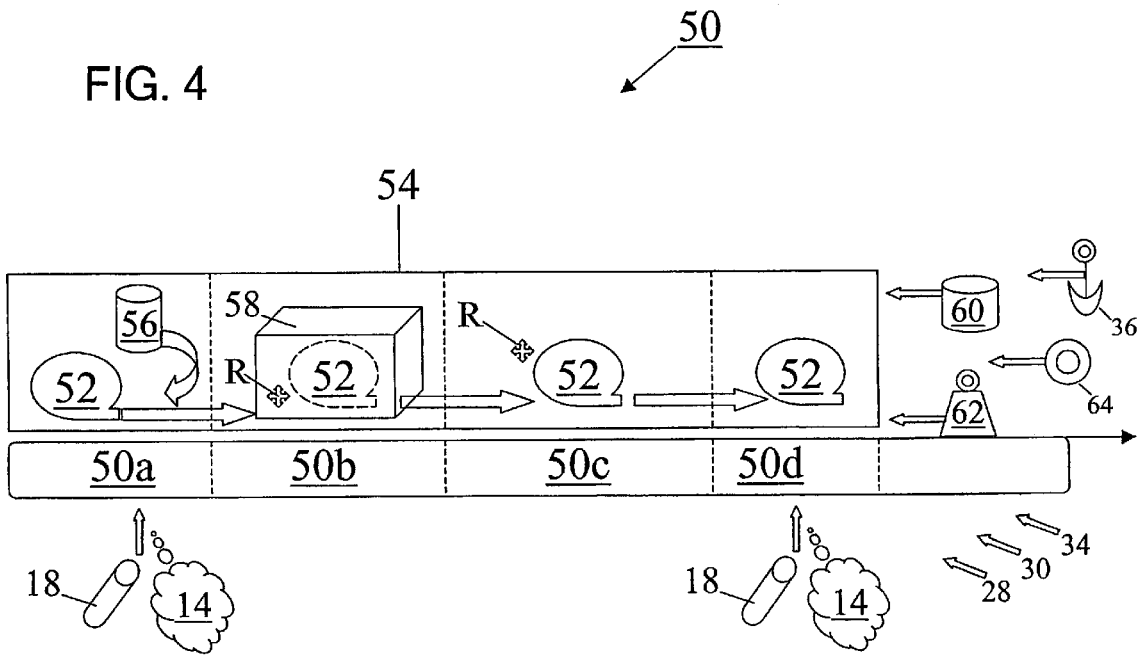
FIG. 4 is a schematic view of an embodiment of a processing line for performing a method of manufacturing a buoy as in FIG. 1.

Turning to FIG. 4, a method of manufacturing the buoy 10 as in FIG. 3 is provided in another aspect of the invention. A processing line 50 is used to practice the method. The method includes the steps of forming the shell 12 to include the shackle pocket 20 and optionally, the lip 26; bonding the tube 18 into the shell 12; injecting or inserting the buoyant element 14 into the shell 12 and about the tube 18; and attaching the support plate 28, the shackle 30, the anchor chain 34, and/or a dead weight or anchor 36.

The step of forming the shell 12 is performed by rotational molding (rotomolding), injection molding, blow molding or the like. By way of example, the rotomolding process starts with a quality cast or fabricated mold 52 as schematically shown in FIG. 4. The mold 52 is placed in a rotomolding machine 54 that has a loading area 50*a*, a heating area 50*b*, a cooling area 50*c*, and a finishing or staging area 50*d*. Pre-measured plastic resin 56 such as HDPE is loaded into the mold 52 in the loading area 50*a*. The mold 52 is moved into an oven 58 in the heating area 50*b* where it is slowly rotated on both vertical and horizontal axes as indicated by the rotating axes symbol R. The melting resin 56 sticks to the hot mold 52 and evenly coats every surface of the mold 52 unless otherwise required, e.g., to form various wall thicknesses. Lastly, the rotomolded shell 12 is moved to the cooling area 50*c* where it is cooled and released from the mold 52 and sent to the staging or finishing area 50*d*.

Rotational speed, heating and cooling times are all controlled throughout the foregoing process and each can be adjusted to modify characteristics of the shell 12, such as its wall thickness. As noted above, the shell 12 can have differing wall thicknesses in particular sections, for instance, about 3/16 of an inch of HDPE at upper and lower sections of the buoy 10 and about ½ of an inch HDPE in a middle section of the buoy 10. Further, although rotomolding the shell 12 has been described by way of example, the shell 12 can be otherwise formed using other steps and materials; for example, by blow molding polypropylene.

The step of bonding the tube 18 into the shell 12 can be performed when the resin 56 is loaded into the mold 52, or after the shell 12 is released from the mold 52. Similarly, the buoyant element 14, described in detail above, can be preformed and placed about the tube 18 for subsequent encapsulation by the shell 12, or injected as a foam for hardening about the tube 18, or as a gas following formation of the shell 12.

Another step in the exemplary method is to affix the lip 26 in the form of a collar device if the lip 26 was not unitarily formed with the shell 12. Also, the shell 12 can be colored during its formation or subsequently painted, and/or customized graphics or color schemes 60 can be applied. The ballast 62 can also be added prior to insertion of the buoyant element 14 or thereafter. Additionally, an underwater float 64 can be attached to the anchor chain 34, for instance, to locate the chain 34.

While preferred embodiments of the invention have been shown and described, those skilled in the art will recognize that other changes and modifications may be made to the foregoing embodiments without departing from the scope and spirit of the invention. For example, specific buoy sizes and dimensions and specific shapes of various elements of the illustrated embodiments may be altered to suit particular applications. It is intended to claim all such changes and modifications as fall within the scope of the appended claims and their equivalents.

Moreover, references herein to "top," "lower," "bottom," "upward," "downward," "upright", and "side" structures, elements and geometries and the like are intended solely for purposes of providing an enabling disclosure and in no way suggest limitations regarding the operative orientation of the exemplary embodiments or any components thereof.

What is claimed is:

1. A buoy for mooring vessels comprising:

a shell having an outer surface with a pocket defined therein, the pocket configured to maintain a fastening device below a plane of the outer surface in a direction of a midpoint of the buoy such that a vessel moored to the buoy is shielded from contact by the fastening device;

a buoyant element retained within the shell to provide flotation; and a support plate disposed in the pocket, the fastening device connected to the support plate such that an external force acting on the fastening device is diffused by the support plate.

2. The buoy as in claim 1, further comprising a tube depending through the midpoint of the buoy, the tube configured for routing a line to anchor the buoy in a body of water, the tube made from a material configured to resist wear and tear from a movement of the line resulting from a motion of the body of water, a motion of the vessel or combinations thereof.

3. The buoy as in claim 1, wherein the buoyant element is one of a polystyrene material, a polyurethane foam, a cork, or a gas.

4. The buoy as in claim 1, wherein the shell is made of a material selected from the group consisting of a polyethylene, a polyvinyl chloride, a rubber, a fiberglass, a nylon, an acetal plastic, a polypropylene, and a polyetheretherketone.

5. The buoy as in claim 4, wherein the shell is made from polyethylene and the polyethylene is a high-density polyethylene.

6. The buoy as in claim 1, wherein the shell is ball-shaped, can-shaped, cone-shaped, or drum-shaped.

7. The buoy as in claim 1, wherein the pocket defines a wall depending downwardly in a direction of the midpoint.

8. The buoy as in claim 7, wherein the wall is bowl-shaped and depends from about 25 degrees to about 75 degrees from a centerline of the buoy.

9. The buoy as in claim 1, wherein the pocket is funnel-shaped.

10. The buoy as in claim 1, wherein the fastening device is a shackle.

11. The buoy as in claim 1, wherein the fastening device is configured to swivel about a centerline of the buoy.

12. The buoy as in claim 1, further comprising an annular lip formed on the outer surface of the shell proximate the pocket, the annular lip configured to increase a depth of the pocket to further shield the fastening device within the pocket.

13. The buoy as in claim 1, wherein the pocket defines a support plate pocket therein, the support plate pocket shaped complementary to the support plate to house the support plate.

14. The buoy as in claim 1, further comprising a ballast configured to affect a buoy characteristic.

15. The buoy as in claim 14, wherein the characteristic is upright stability, or counterweight.

16. The buoy as in claim 1, further comprising a line to anchor the buoy in the body of water.

17. A mooring device for a buoy comprising:

a shackle for attaching a mooring line from a vessel;

a pocket defined in a surface of a buoy to retain the shackle below the surface in a direction of a midpoint of the buoy such that a hull of the vessel moored to the buoy is shielded from contact by the shackle;

a protrusion disposed proximate the pocket depending from the surface of the buoy in a direction away from the midpoint, the protrusion configured to increase a size of the pocket such that the shackle is further removed from the surface of the buoy, the protrusion further configured to make contact with the vessel in lieu of the shackle; and a support plate disposed in the pocket, the support plate connected to the shackle and to an anchor chain for anchoring the buoy in a body of water.

18. The mooring device as in claim 17, wherein the shackle is configured to swivel about a centerline of the buoy.

19. The mooring device as in claim 17, wherein a distal end of the shackle terminates beneath an outermost edge of the protrusion.

20. The mooring device as in claim 17, wherein the pocket is bowl-shaped or funnel-shaped.

21. The mooring device as in claim 17, wherein the surface of the buoy is made of a material selected from the group consisting of a polypropylene, a polyethylene, a polyvinyl chloride, a rubber, a fiberglass, a wood and combinations thereof.

22. The mooring device as in claim 17, wherein the protrusion is a collar affixed to the surface.

23. The mooring device as in claim 17, further comprising a buoyant element disposed beneath the surface of the buoy, the buoyant element selected from the group consisting of a polystyrene material, a polyurethane foam, a cork, a gas, and combinations thereof.

24. The mooring device as in claim 17, wherein the pocket defines a support plate pocket therein, the support plate pocket shaped complementary to the support plate to house the support plate.

25. A method of manufacturing a buoy, comprising the steps of:

forming a shell defining a shackle pocket therein;

bonding a tube within the shell;

inserting a buoyant element into the shell and about the tube;

attaching a shackle within the shackle pocket such that the shackle is disposed beneath a surface of the shell; and attaching a support plate in the shackle pocket, the shackle attached to the support plate.

26. The method as in claim 25, wherein the shell is formed by rotational molding, blow molding, or injection molding.

27. The method as in claim 25, further comprising the steps of forming the buoyant element, placing the formed buoyant element about the tube, and forming the shell about the buoyant element and tube for encapsulation by the shell.

28. The method as in claim 25, further comprising the step of injecting the buoyant element into the formed shell.

29. The method as in claim 28, further comprising the step of hardening the buoyant element about the tube in the formed shell.

30. The method as in claim 25, further comprising the step of attaching an anchor chain, a dead weight, an anchor or combinations thereof to the buoy.

31. The method as in claim 25, further comprising the step of adding ballast to the buoy.

32. The method as in claim 25, further comprising the step of forming a lip on the shell proximate the shackle pocket, the lip configured to shield a vessel from the shackle.

33. The method as in claim 25, further comprising the step of attaching a lip on the shell proximate the shackle pocket after formation of the shell, the lip configured to shield a vessel from the shackle.

34. A processing line for manufacturing a mooring buoy according to claim 1, the processing line comprising:

means for forming a buoy shell defining a shackle pocket therein;

means for bonding a tube within the buoy shell;

means for inserting a buoyant element into the shell and about the tube; and means for attaching a shackle within the shackle pocket such that the shackle is disposed beneath a surface of the buoy shell.

35. A buoy for mooring vessels comprising:

a shell having an outer surface with a pocket defined therein, the pocket configured to maintain a fastening device below a plane of the outer surface in a direction of a midpoint of the buoy such that a vessel moored to the buoy is shielded from contact by the fastening device;

a buoyant element retained within the shell to provide flotation; and a support plate disposed in the pocket, the fastening device and the line connected to the support plate such that an external force acting on the fastening device or the line is diffused by the support plate.

* * * * *